US009153156B2

(12) United States Patent
Tomura et al.

(10) Patent No.: US 9,153,156 B2
(45) Date of Patent: Oct. 6, 2015

(54) LIQUID CRYSTAL DISPLAY DEVICE THAT ADDRESSES NON-SYNCHRONOUS RESPONSE TIMES

(71) Applicant: YAZAKI CORPORATION, Tokyo (JP)

(72) Inventors: Kazuyoshi Tomura, Shizuoka (JP); Daisuke Satsukawa, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 30 days.

(21) Appl. No.: 14/065,940

(22) Filed: Oct. 29, 2013

(65) Prior Publication Data

US 2014/0125562 A1 May 8, 2014

(30) Foreign Application Priority Data

Nov. 7, 2012 (JP) ..... 2012-245600

(51) Int. Cl.
*G09G 3/18* (2006.01)
*G09G 3/04* (2006.01)

(52) U.S. Cl.
CPC ..... *G09G 3/04* (2013.01); *G09G 2320/0252* (2013.01); *G09G 2320/041* (2013.01)

(58) Field of Classification Search
CPC ..... G09G 3/04
USPC ..... 345/33–38
See application file for complete search history.

(56) References Cited

U.S. PATENT DOCUMENTS 4,556,877 A * 12/1985 Kumagai et al. ..... 345/214
4,745,403 A 5/1988 Tamura

FOREIGN PATENT DOCUMENTS

JP 59-9641 A 1/1984

* cited by examiner

*Primary Examiner* — Sanghyuk Park
(74) *Attorney, Agent, or Firm* — Kenealy Vaidya LLP

(57) ABSTRACT

A liquid crystal display device includes a display part which has a plurality of divided segments and a control part, configured to control voltages applied to the segments. The control part changes a turning-on pattern of segments to be output to the display part from a first turning-on pattern which turns on a first segment group to a second turning-on pattern which turns on a second group, and subsequently to a third turning-on pattern which turns on a third segment group. Change of the turning-on pattern includes a control to apply a voltage to at least one of segments of the plurality of segments which are not commonly used in the first segment group in a period from a predetermined time before starting of change to the third turning-on pattern.

6 Claims, 7 Drawing Sheets

LIQUID CRYSTAL DISPLAY DEVICE THAT ADDRESSES NON-SYNCHRONOUS RESPONSE TIMES

CROSS REFERENCE TO RELATED APPLICATIONS

This application is based on and claims the benefit of Japanese Patent Application No. 2012-245600 filed on Nov. 7, 2012, the contents of which are incorporated herein by reference in its entirety.

BACKGROUND OF THE INVENTION

1. Field of the Invention

The present invention relates to a liquid crystal display device.

2. Description of the Related Art

A segment type liquid crystal display device is known as a liquid crystal display device, which includes a display part that has a plurality of divided segments, and which controls voltages applied to the segments to turn on/off the segments, thereby displaying various information (for example, refer to JP-A-59-9641).

SUMMARY OF THE INVENTION

The liquid crystal display device disclosed in JP-A-59-9641 is a liquid crystal display device which includes a seven-segment type display part which includes seven segments. When a voltage applying is started or stopped, by delaying the timing when the voltage applying is started for a predetermined time from the timing when the voltage applying is stopped, the falling curve when the voltage applying is stopped and the rising curve when the voltage applying is started pass through the transmittance threshold of the liquid crystal at the same time.

According to the liquid crystal display device of JP-A-59-9641, erroneous display or low contrast due to the temperature change of the liquid crystal display device can be prevented.

In recent years, a liquid crystal display device which has a higher visibility is demanded.

An unlimited object of the present invention is to provide a liquid crystal display device whose visibility is improved.

Some aspects of the liquid crystal display devices according to the present invention are mentioned as in the following configurations (1) to (4).

(1) A liquid crystal display device, including:

a display part which has a plurality of divided segments; and a control part, configured to control voltages applied to the segments to turn on or turn off each of the segments, wherein the control part changes a turning-on pattern of segments to be output to the display part from a first turning-on pattern to a second turning-on pattern, and subsequently to a third turning-on pattern, wherein the first turning-on pattern turns on a first segment group selected from the plurality of segments, the second turning-on pattern turns on a second segment group selected from the plurality of segments, and the third turning-on pattern turns on a third segment group selected from the plurality of segments, wherein change of the turning-on pattern includes a control to apply a voltage to at least one of segments of the plurality of segments which are not commonly used in the first segment group in a period from a predetermined time before starting of change from the second turning-on pattern to the third turning-on pattern to the starting of the change.

(2) The liquid crystal display device according to the configuration (1), further including a temperature detecting part, configured to detect an ambient temperature of the liquid crystal display device, wherein the control part applies a voltage to at least one of segments of the plurality of segments which are not commonly used in the first segment group in a case where it is determined that a value of the ambient temperature acquired by the temperature detecting part is equal to or lower than a given threshold.

(3) The liquid crystal display device according to the configuration (1) or (2), wherein the control part applies a voltage to at least one of segments of the plurality of segments which are not commonly used in the first segment group in the period from the predetermined time before the starting of the change to the starting of the change, and to apply a voltage to at least one of the first segment group which are not commonly in the second segment group for a predetermined time from the starting of the change.

(4) The liquid crystal display device according to the configuration (3), wherein the control part applies a voltage to at least one of the segments of the first segment group which are not commonly used in the second segment group from starting of the change, in a time period obtained by subtracting a response time until the segments are turned off from a response time until the segments are turned on under a predetermined temperature environment.

For the liquid crystal display device according to the configuration (1), when the turning-on pattern to be output to the display part is changed from the first turning-on pattern to the second turning-on pattern and subsequently changed to the third turning-on pattern, in a period before a predetermined time before starting of change from the second turning-on pattern to the third turning-on pattern, a voltage is applied to segments of the plurality of segments, which are not commonly in the first segment group. Thereby, the deviation in display due to the fact that the response times until the segments are turned on are different depending on elapsed time from the previous turning-off time can be prevented from occurring.

For the liquid crystal display device according to the configuration (2), when the value of the ambient temperature of the liquid crystal display device is equal to or lower than the predetermined threshold, a voltage is applied to the segments of the first segment group, which are not commonly in the second segment group. Thereby, if the liquid crystal display device is used in a low temperature environment where the difference between the response time until the segments are turned on and the response time until the segments are turned off is easy to appear apparently, the deviation in display is effectively prevented from occurring.

For the liquid crystal display device according to the configuration (3), for a predetermined time from starting the change, a voltage is further applied to at least one of segments of the first segment group which are not commonly in the second segment group. Thereby, the deviation in display due to the fact that the response time until the segments are turned on is longer than the response time until the segments are turned off can be prevented from occurring.

For the liquid crystal display device according to the configuration (4), in a period, which is obtained by subtracting the response time until the segments are turned off from the response time until the segments are turned on under the predetermined temperature environment, from starting of the change, a voltage is applied to the segments of the first segment group, which are not commonly in the second segment group. Thereby, the deviation in display due to the fact that the response time until the segments are turned on is longer than the response time until the segments are turned off can be more effectively prevented from occurring.

According to the liquid crystal display device of the present invention, the liquid crystal display device whose visibility is improved can be provided.

The present invention has been briefly described above. Further, details of the present invention will become more apparent after exemplary embodiments of the invention described below are read with reference to the accompanying figures.

BRIEF DESCRIPTION OF THE DRAWINGS

In the accompanying drawings:

FIG. 5 is a graph for showing a relationship between the elapsed time from the previous turning-off time point and the response time until a segment is turned on, in which the horizontal axis shows the elapsed time from the previous turning-off time point, and the vertical axis shows the response time until a segment is turned on;

DETAILED DESCRIPTION OF THE EXEMPLARY EMBODIMENTS

A liquid crystal display device according to an embodiment of the present invention is described below with reference to the figures.

Figure 1:
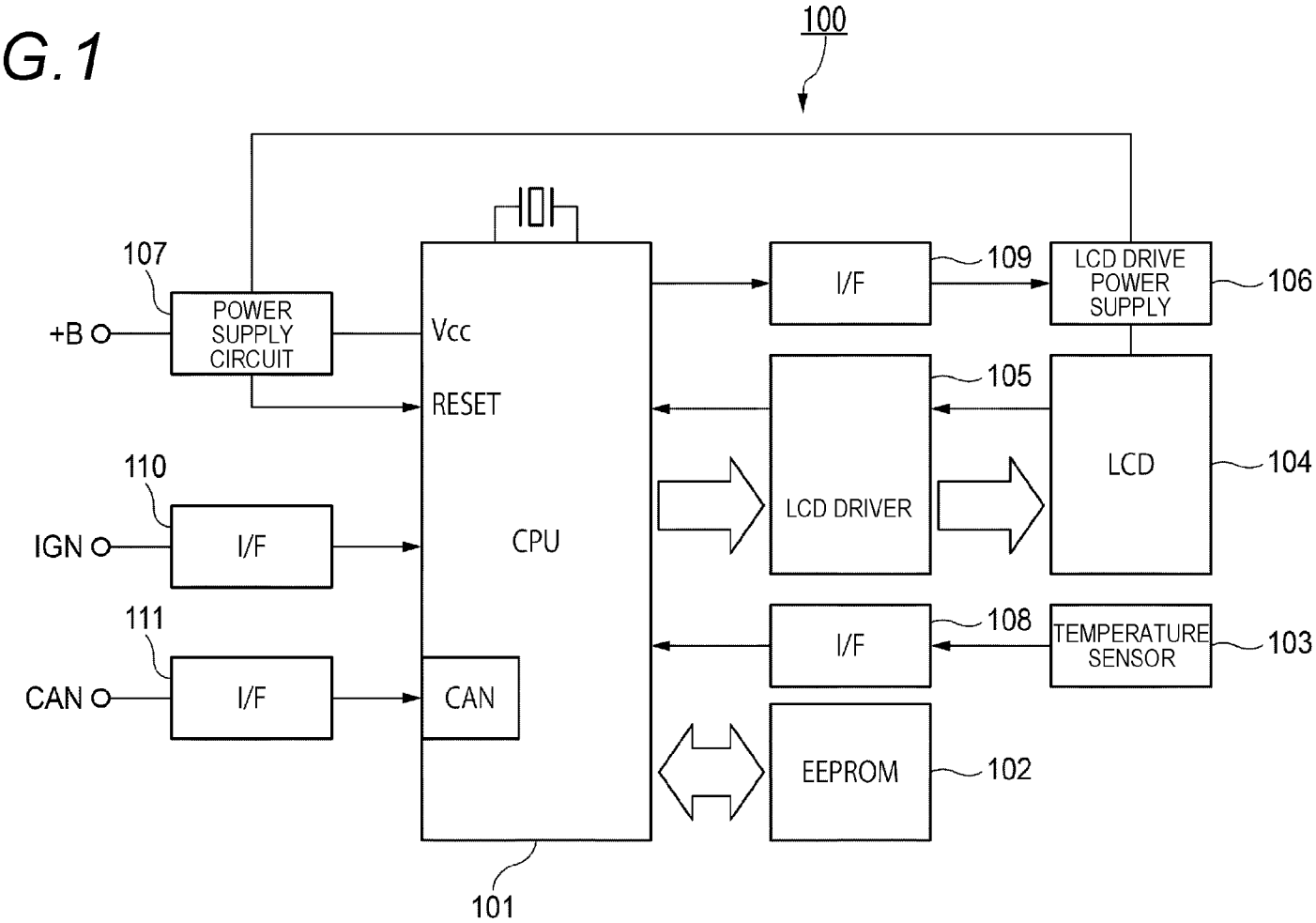
FIG. 1 is a block diagram which shows a hardware construction example of a liquid crystal display device 100 according to an embodiment.

FIG. 1 is a block diagram which shows a hardware construction example of a liquid crystal display device 100 according to the present embodiment.

As shown in FIG. 1, the liquid crystal display device 100 includes a microcomputer (CPU: Central Processing Unit) 101, an EEPROM (Electrically Erasable Programmable Read-Only Memory) 102, a temperature sensor 103, an LCD (Liquid Crystal Display) 104, an LCD driver 105, an LCD drive power supply 106, a power supply circuit 107 and interfaces (I/F) 108 to 111. These components are described in detail as follows.

The microcomputer 101 is a control part which executes programs prepared beforehand and performs various processes necessary to implement functions of the liquid crystal display device 100. For example, the microcomputer 101 performs the control of turning on/off the LCD 104 to be described below.

Figure 8:
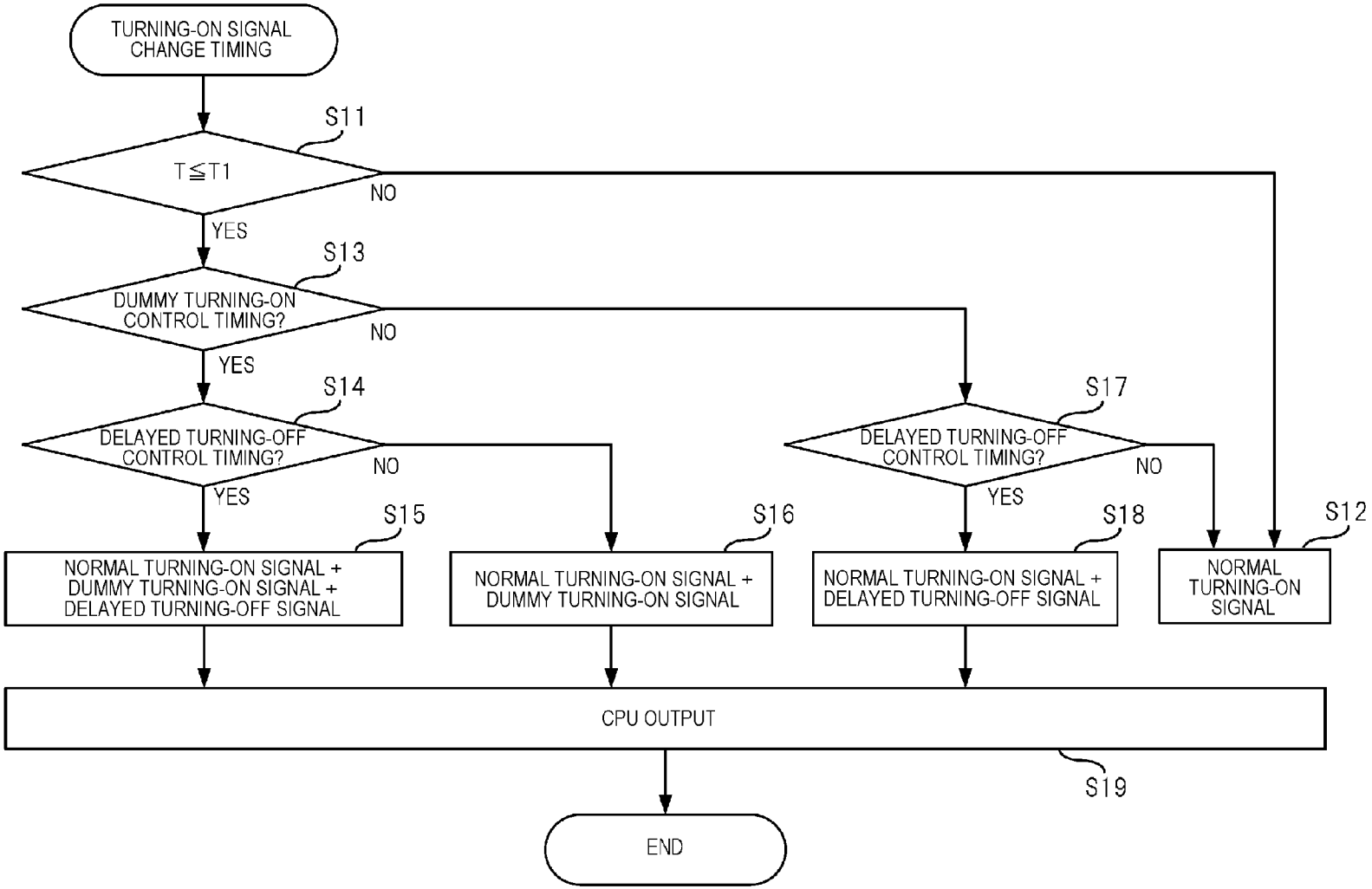
FIG. 8 is a flowchart to describe the display control of the liquid crystal display device 100 according to the present embodiment.

The EEPROM 102 is an electrically rewritable memory and serves as a recording part which holds various data to which the microcomputer 101 refers. For example, the value of a temperature threshold T1 to which the microcomputer 101 refers in a step S11 of the process shown in FIG. 8 is held by the EEPROM 102.

The temperature sensor 103 is a temperature detecting part which detects the value of an ambient temperature T of the liquid crystal display device 100, and outputs the detected value of the ambient temperature T to the microcomputer 101 via the interface 108. For example, a known thermistor is used as the temperature sensor 103. The temperature sensor 103 is attached to a place where the ambient temperature T of the liquid crystal display device 100 can be measured. The temperature sensor 103, for example, is attached to a liquid crystal panel of the LCD 104, and detects the temperature of the liquid crystal panel as the ambient temperature T. Alternatively, the temperature sensor 103 is attached to an outer surface of the housing of the liquid crystal display device 100, and calculates the atmospheric temperature around the liquid crystal display device 100 as the ambient temperature T.

Figure 2:
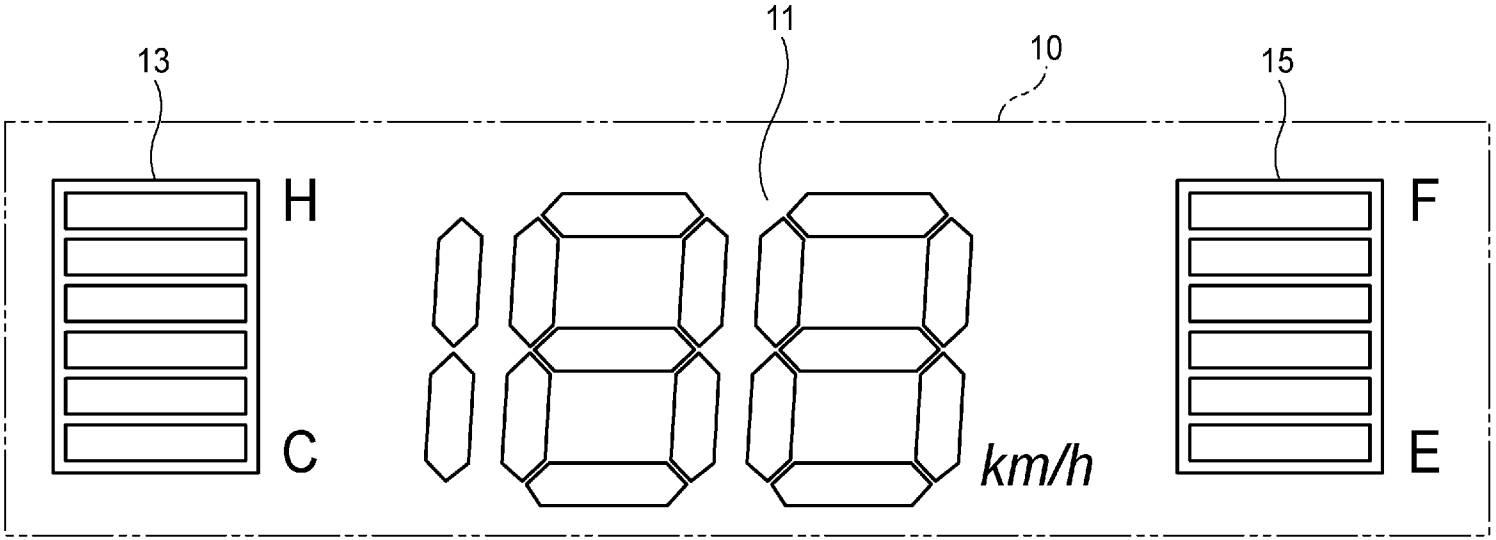
FIG. 2 shows a display screen 10 of an LCD 104.

The LCD 104 is a display part which displays various information on a rectangular planar display screen 10. In this embodiment, the display screen 10 of the LCD 104, as shown in FIG. 2, includes a speed display part 11 which displays the current vehicle speed, a water temperature display part 13 which displays the cooling water temperature, and a fuel display part 15 which displays the fuel residual quantity. When a predetermined driving voltage is applied to the LCD 104 by the LCD drive power supply 106, the LCD 104 is switched to an ON state. The microcomputer 101 outputs signals to the LCD drive power supply 106 via the interface 109 to control the application of the driving voltage, and thereby controls the ON/OFF of the power supply of the LCD 104.

The speed display part 11 is a known digital speedometer. By changing the turning-on pattern according to the displaying numbers, the speed display part 11 displays either one of the numbers "0" to "9" at the first digit and the second digit with a seven-segment display in which seven divided segments are used, and displays "1" at the third digit with a two-segment display in which two segments are used. These segments are controlled by the microcomputer 101 to be turned on or turned off.

More specifically, the microcomputer 101 outputs turning-on signals including the information about turning on or turning off the segments to the LCD driver 105. The LCD driver 105, which receives the turning-on signals, determines voltage values applied to the segments of the LCD 104 based on the turning-on signals, and outputs signals which represent the determined voltage values for the segments to the LCD 104. With the operation of the LCD 104 according to the signals which the LCD driver 105 outputs, the segments of the speed display part 11 are turned on or turned off. That is, for the liquid crystal display device 100 according to the present embodiment, the microcomputer 101 controls the display of the LCD 104 in a dynamic drive mode for which voltages whose voltage values are variable are applied to the segments of the LCD 104.

More specifically, the segment of the speed display part 11 of the liquid crystal display device 100 according to the present embodiment is turned on when a voltage whose absolute value is larger than a critical voltage (for example, 3V.) which is a voltage to turn on the segment is applied. Therefore, when the LCD driver 105 receives the turning-on signals, except the case in which a dummy turning-on control to be described below is performed, the LCD driver 105 outputs the signals to the LCD 104 to apply a turning-on voltage whose voltage value is above the critical voltage (for example, 5V) to each of the segments which should be turned on, and not to apply the voltage to the segments which should be turned off. Thereby, voltage values, which are adapted to the turning-on pattern to be displayed, are applied to the segments of the speed display part 11, and the segments are turned on or off.

Like the speed display part 11, the water temperature display part 13 and the fuel display part 15 operate according to the output signals from the LCD driver 105 to display the cooling water temperature and the fuel residual quantity since the display elements are turned on/off under control of the microcomputer 101.

The power supply circuit 107 is driven by being applied an applied voltage +B from a battery carried in the vehicle which is an outer power supply, and applies a driving voltage Vcc to the microcomputer 101 to drive the microcomputer 101. The power supply circuit 107 outputs a reset signal RESET to the microcomputer 101 to initialize the driving of the microcomputer 101.

The interface 110 is an interface used by the microcomputer 101 to receive an ignition signal (IGN) which represents the ON/OFF of an ignition switch. The interface 111 is an interface used by the microcomputer 101 to receive a CAN signal including various information about the vehicle such as the vehicle speed, the water thermometer temperature or the like from a communication network (CAN: Controller Area Network) in the vehicle.

Next, the display control of the speed display part 11 in the liquid crystal display device 100 is described.

(An Operation Example of a Traditional Liquid Crystal Display Device)

Figure 3:
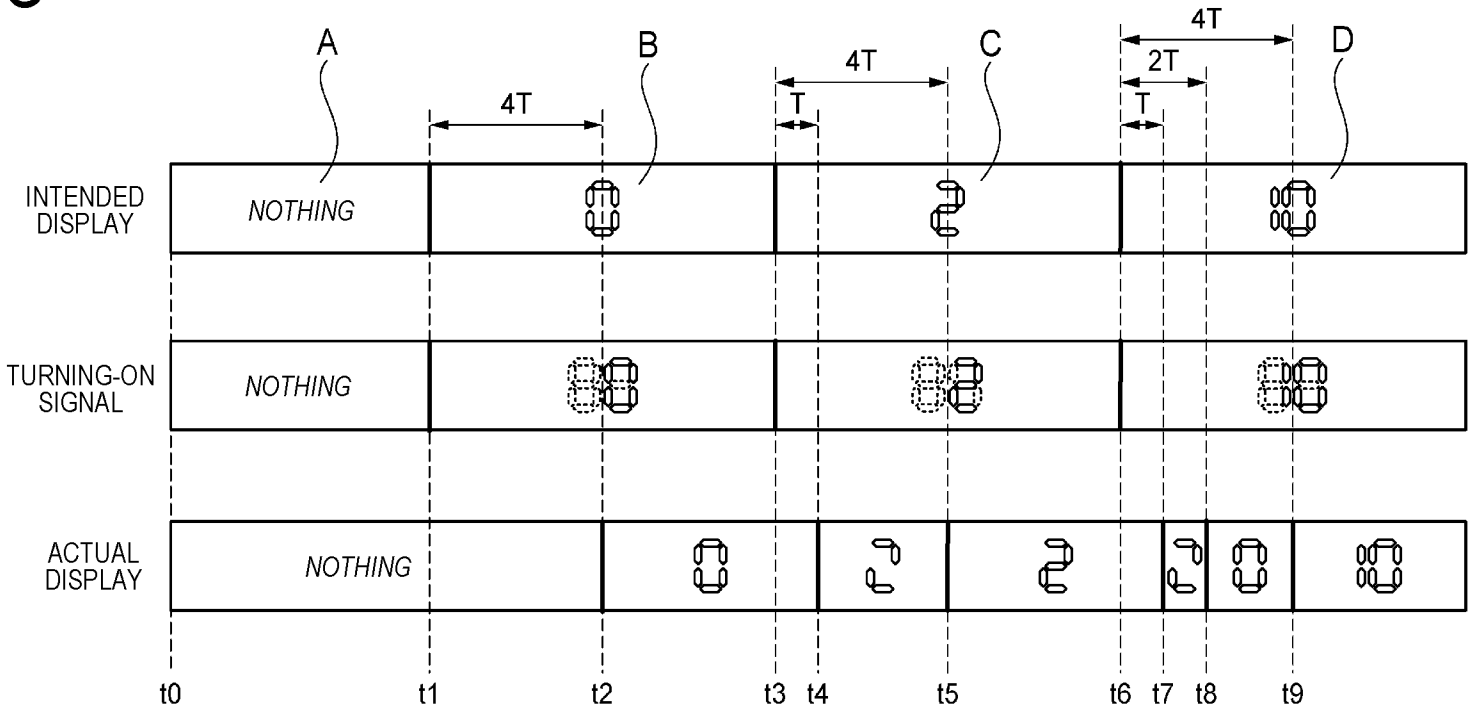
FIG. 3 is a time chart to describe a display control of a traditional liquid crystal display device.

First, before describing the display control of the speed display part 11 of the LCD 104 in the liquid crystal display device 100 according to the present embodiment, an example of the display control of a traditional liquid crystal display device is described as a comparative example with reference to FIG. 3. FIG. 3 is a time chart to describe a display control of the traditional liquid crystal display device.

In the following description, to simplify the description, since the traditional liquid crystal display device has the same hardware components as those of the liquid crystal display device 100 according to the present embodiment, the same numbers as those of the liquid crystal display device 100 according to the present embodiment are given to the component elements of the traditional liquid crystal display device. In FIG. 3, the horizontal axis shows the elapsed time from the start of the display, and the upper section shows the display contents that should be (are intended to be) displayed on the speed display part 11 at various time points, the middle section shows turning-on signals which are output to the LCD driver 105 from the microcomputer 101 at various time points, and the lower section shows the display contents that are actually displayed on the speed display part 11 at various time points. However, to simplify the description, in FIG. 3, the case in which the display control is performed is exemplified only with the display elements of the first digit and the second digit.

Figure 4:
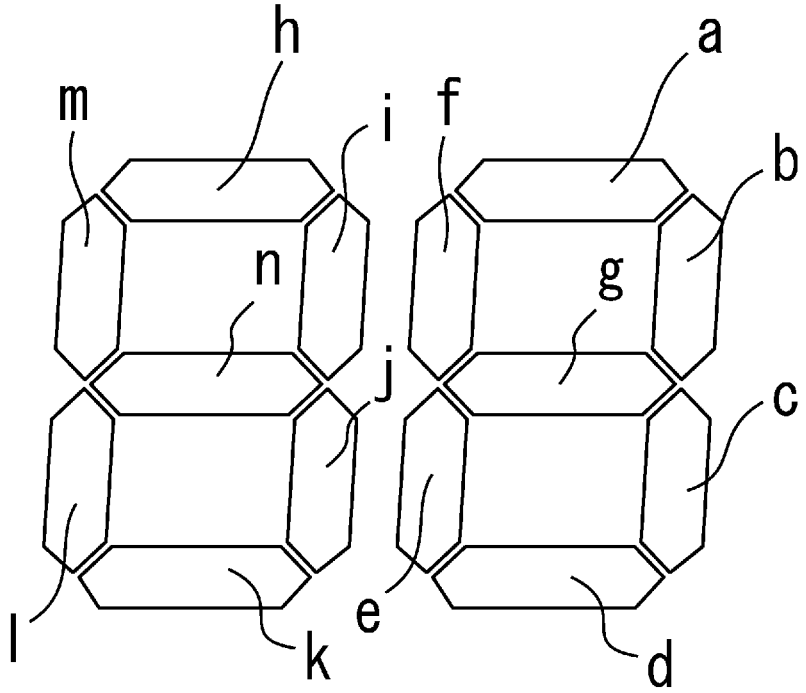
FIG. 4 is an illustrative diagram for showing symbols given to segments of a speed display part 11.

In the example shown in FIG. 3, as the display contents that should be displayed, the intended display is exemplified as: from a start state at a time point t0 when nothing is displayed, to a time point t1 when "0" is started to be displayed, to a time point t3 when the display is changed from "0" to "2", and to a time point t6 when the display is changed from "2" to "10". In the following, to simplify the description in this specification, as shown in FIG. 4, letters a to g are given to the segments of the seven-segment display of the first digit, and letters h to n are given to the segments of the seven-segment display of the second digit. When these letters are used to describe, in FIG. 3, the intended display is exemplified as follows: the turning-on pattern which is displayed on the speed display part 11, is a turning-on pattern A in which no segment is turned on at the time point t0, is changed at the time point t1 from the turning-on pattern A to a turning-on pattern B in which a segment group B which includes the segments a, b, c, d, e and f is turned on to display "0", is changed at the time point t3 from the turning-on pattern B to a turning-on pattern C in which a segment group C which includes the segments a, b, d, e and g is turned on to display "2", and is changed at the time point t6 from the turning-on pattern C to a turning-on pattern D in which a segment group D which includes the segments a, b, c, d, e and f and the segments i and j is turned on to display "10". In the following, the description is based on the turning-on pattern A in which a segment group A which includes none of the segments is turned on.

First, at the time point t1, the microcomputer 101 outputs a turning-on signal to the LCD driver 105 to start the display "0" at the first digit. That is, the turning-on signal is output to the LCD driver 105 to turn on the turning-on pattern B. At this time, as shown in FIG. 3, it takes 4T from the time when the microcomputer 101 outputs the turning-on signal (from the time point t1), to the time when "0" is actually displayed on the speed display part 11 (to the time point t2), if a time T shown in FIG. 3 is assumed as one time unit (the time T is the response time until a segment is turned off, to be described below). This is because, for the LCD 104 (the speed display part 11) of the traditional liquid crystal display device, a response time A which is the response time until a turned-off segment is turned on is 4T.

Next, at the time point t3, the microcomputer 101 outputs a turning-on signal to the LCD driver 105 to start the display of "2". That is, the turning-on signal is output to the LCD driver 105 to turn on the turning-on pattern C. At this time, as shown in FIG. 3, it takes a response time A which is 4T from the time when the microcomputer 101 outputs the turning-on signal (from the time point t3), to the time when "2" is actually displayed on the speed display part 11 (to the time point t5). At this time, the time period until the time when "2" is actually displayed on the speed display part 11 (from the time point t3 to the time point t5) includes a period in which the turning-on pattern B remains (time T from the time point t3 to the time point t4) and a period in which the turning-on pattern B is changed to the turning-on pattern C (time 3T from the time point t4 to the time point t5).

The turning-on pattern B remains in the period from the time point t3 to the time point t4 because a response time B which is the response time until the segments are turned off is 1T. In addition, as shown in FIG. 3, in a period of 3T from the time point t4 to the time point t5, that is, when the turning-on pattern B is changed to the turning-on pattern C, only the segments a, b, d and e in the segment group C are displayed. That is, the turning-on pattern C to display "2" is turned on and displayed except one segment. This is because for the LCD 104 (the speed display part 11) of the traditional liquid crystal display device, since the response time B which is the response time until a segment is turned off is 1T, the time when the segments c and f are turned off is 3T earlier than the time (the display time) when the segment g is turned on which corresponds to the response time A (4T).

Next, at the time point t6, the microcomputer 101 outputs a turning-on signal to the LCD driver 105 to start the display of "10". That is, the turning-on signal is output to the LCD driver 105 to turn on the turning-on pattern D. As shown in FIG. 3, it takes a response time A which is 4T from the time when the microcomputer 101 outputs the turning-on signal (from the time point t6), to the time when "10" is actually displayed on the speed display part 11 (to the time point t9). In addition, the time period until the time when "10" is actually displayed on the speed display part 11 (from the time point t6 to the time point t9) includes a period in which the turning-on pattern C remains (time T from the time point t6 to the time point t7) and a period in which the turning-on pattern C is changed to the turning-on pattern D (time 3T from the time point t7 to the time point t9).

As shown in FIG. 3, only the segments a, b, d and e in the segment group D are displayed in the 1T period from the time point t7 to the time point t8. This is because the segment g in the segment group C of the turning-on pattern C which is the turning-on pattern before the change is turned off in the response time B (1T).

Only the segments a, b, c, d, e and f in the segment group D are displayed in the 2T period from the time point t8 to the time point t9. This is because for the LCD 104 (the speed display part 11) of the traditional liquid crystal display device, since when a segment which is commonly used in the previous turning-on pattern which is the turning-on pattern further before the turning-on pattern before the change (for the turning-on pattern change at the time point t6, the previous turning-on pattern is the turning-on pattern B) is turned on, a response time C which is the response time necessary to turn on the segment is 2T, the time when the segments c and f are turned on is 2T earlier than the time (the display time taken for the segments i and j to be newly turned on, which is the response time A (4T)) when the segments i and j are turned on.

Figure 5:
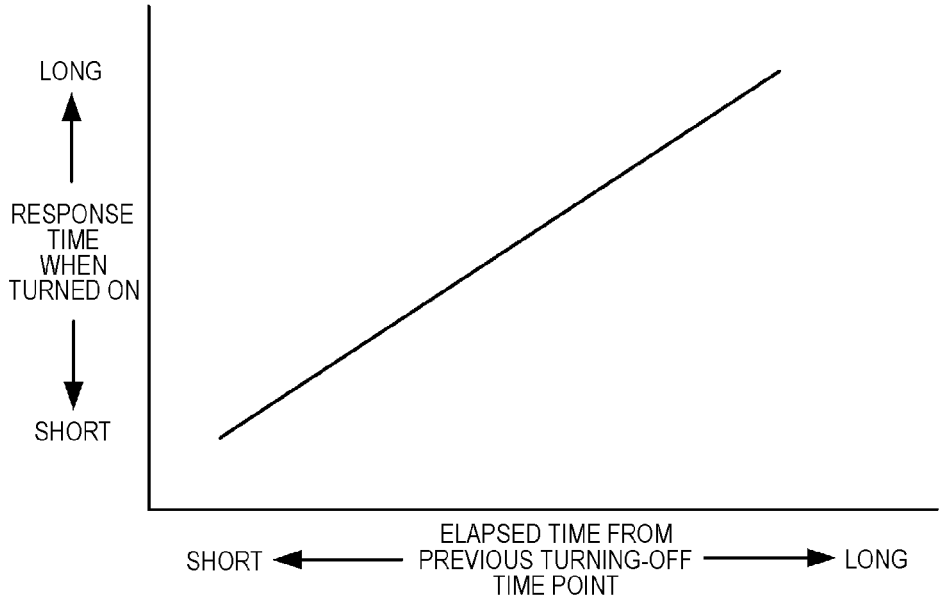

Here, the difference appears between the response time A (4T) when the segments are newly turned on and the response time C (2T) when the segments which are commonly used in the previous turning-on pattern are turned on, as shown in FIG. 5, because the longer the elapsed time is from the previous turning-off time point, the longer the response time is for the segments to be turned on.

As described above, for the traditional liquid crystal display device, the response time A (4T) when a segment is newly turned on, the response time B (1T) when a segment is turned off, and the response time C (2T) when a segment which is commonly used in the previous turning-on pattern is turned on are different from each other. Thus, as shown with the display from the time point t4 to t5, the display from the time point t7 to the time point t8, and the display from the time point t8 to the time point t9 in FIG. 3, when the turning-on pattern is changed, since the segments are not turned on or turned off synchronously, and part of the segments are changed in different timings, thereby generating deviation in display. Thereby, inventors of this application recognize that the visibility of the liquid crystal display device may be lowered, and the display quality may be decreased.

Figure 6:
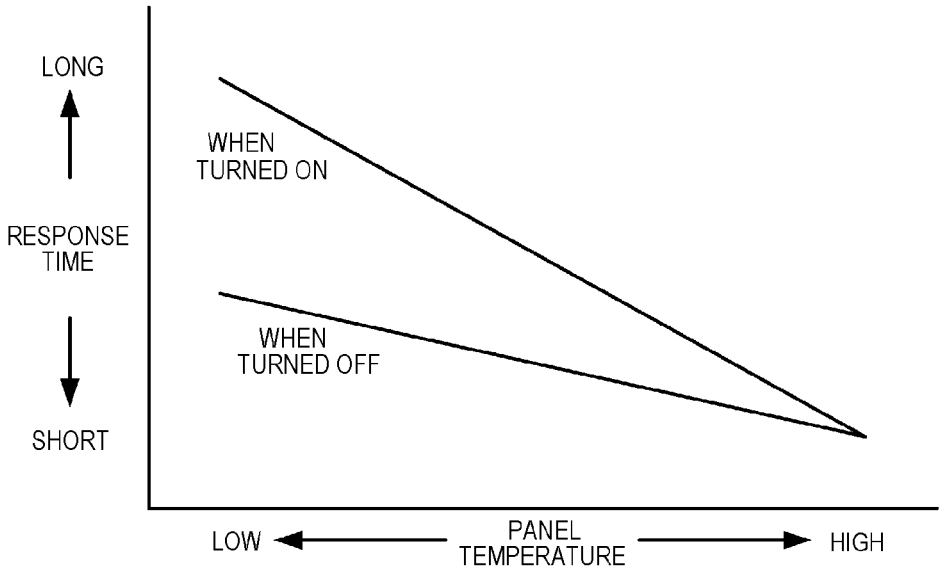
FIG. 6 is a graph for showing the response time until a segment is turned on and the response time until a segment is turned off, in which the horizontal axis shows the panel temperature of the LCD 104, and the vertical axis shows the response times for the panel temperature.

The difference between the response times when a segment is turned on (the response time A and the response time C) and the response time B when a segment is turned off, as shown in FIG. 6, become larger as the panel temperature of the LCD 104 becomes lower. Therefore, the inventors of this application recognize that as the ambient temperature of the liquid crystal display device becomes lower, the difference between the response times when a segment is turned on and the response time until a segment is turned off becomes larger, and deviation in display when the turning-on pattern is changed occurs.

(Operations of the Liquid Crystal Display Device 100 According to the Present Embodiment)

Figure 7:
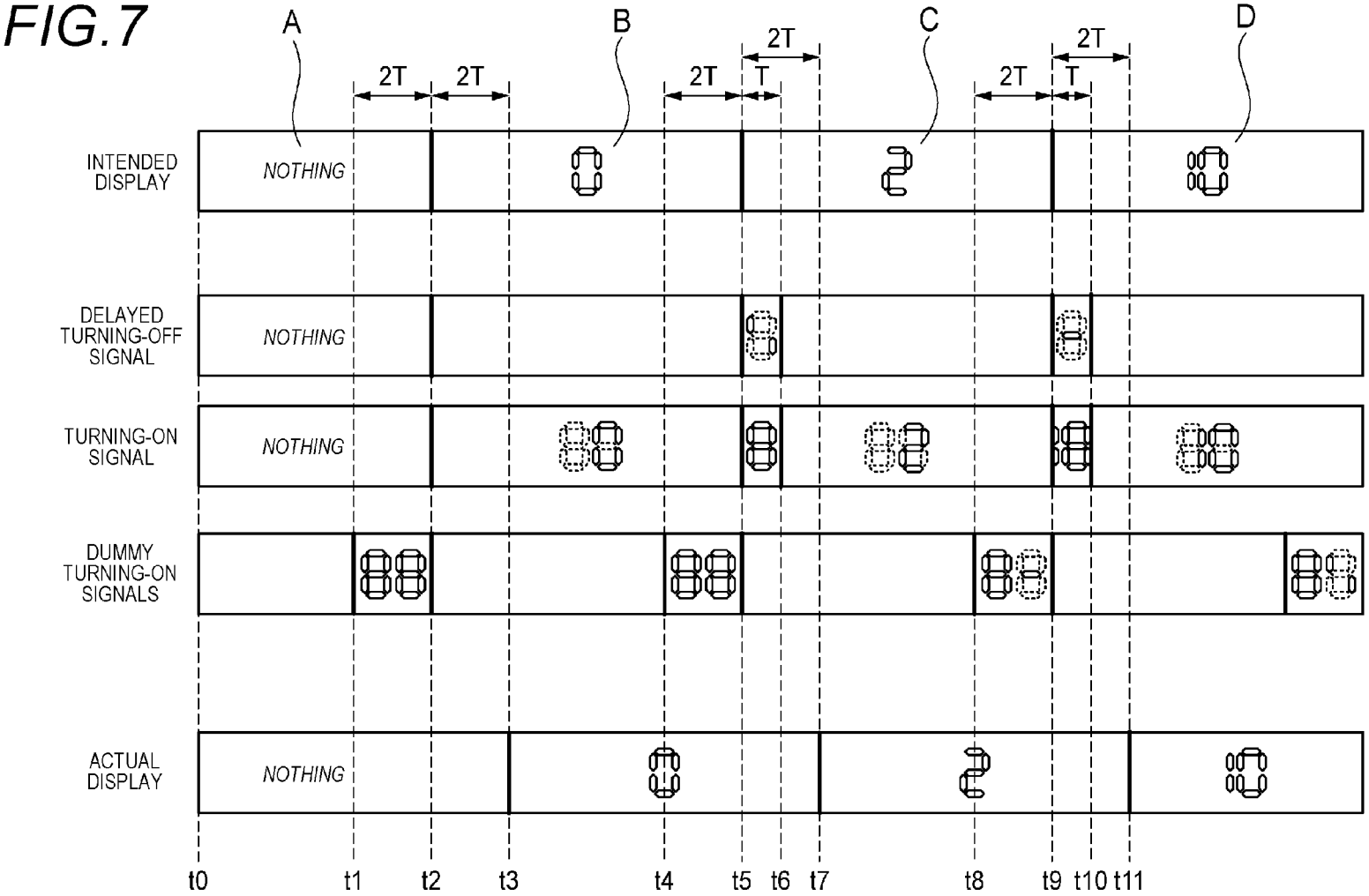
FIG. 7 is a time chart to describe a display control of the liquid crystal display device 100 according to the present embodiment.

Next, with reference to FIG. 7, a display control of the speed display part 11 of the LCD 104 of the liquid crystal display device 100 according to the present embodiment is described. FIG. 7 is a time chart to describe the display control of the liquid crystal display device 100 according to the present embodiment.

First, the difference between the display control of the liquid crystal display device 100 according to the present embodiment and the display control of the traditional display control is described.

Schematically, for the liquid crystal display device 100 according to the present embodiment, with the combination of two display controls, which are a dummy turning-on control and a delayed turning-off control to be described below, if the turning-on pattern is to be changed, 2T (which is the response time C until the segments which are commonly used in the previous turning-on pattern are turned on) after the change time point, the turning-on pattern is changed at once.

First, when the dummy turning-on control of the liquid crystal display device 100 according to the present embodiment 100 is performed, to prevent the deviation in display which is caused by the difference between the response time until a segment is newly turned on and the response time until a segment which is commonly used in the previous turning-on pattern is turned on, in a period from a predetermined time before the change of the turning-on pattern to the time point of the change, a dummy voltage (for example, 1V) whose absolute voltage value is smaller than the critical voltage is applied to a dummy segment group which is a segment group, which is not commonly used (not included) in the segment group of the previous turning-on pattern, of all the segments. The operation of the dummy turning-on control will be described below in detail.

Second, when the delayed turning-off control of the liquid crystal display device 100 according to the present embodiment 100 is performed, to prevent the deviation in display which is caused by the difference between the above response time until a segment is turned on and the response time until a segment is turned off, from the time point when the turning-on pattern is changed, in a period obtained by subtracting the response time until a segment is turned off from the response time until a segment is turned on, a delayed turning-off voltage (for example, 5V) whose absolute voltage value is larger than the critical voltage is applied to a delayed turning-off segment group which is a segment group, which is not commonly used in the segment group of the turning-on pattern after the change, of the segment group of the turning-on pattern before the change (that is, the delayed turning-off segment group is turned on). The operation of the delayed turning-off control will be described below in detail.

For the traditional liquid crystal display device described above, the response times until the segments are turned on may be either the response time A (4T) until a segment is newly turned on or the response time C (2T) until a segment which is commonly used in the previous turning-on pattern is turned on. However, for the liquid crystal display device 100 according to the present embodiment, by the dummy turning-on control described above, the response times until the segments are turned on are equalized to the response time C (2T) until a segment which is commonly used in the previous turning-on pattern is turned on.

A display control example in the liquid crystal display device 100 according to the present embodiment is described with reference to FIG. 7. In FIG. 7, like the case in FIG. 3, to simplify the description, the case in which the display control is performed is exemplified only with the display elements of the first digit and the second digit.

In FIG. 7, the horizontal axis shows the elapsed time from the start of the display, the uppermost section shows the display contents that should be (are intended to be) displayed on the speed display part 11 at various time points, the second section shows those parts (delayed turning-off signals), which are output by the delayed turning-off control, of turning-on signals which are output to the LCD driver 105 from the microcomputer 101 at various time points, the third section shows the turning-on signals which are output to the LCD driver 105 from the microcomputer 101 at various time points, the fourth section shows dummy turning-on signals which are output to the LCD driver 105 from the microcomputer 101 by the dummy turning-on control at various time points, and the fifth section shows the display contents that are actually displayed on the speed display part 11 at various time points.

In FIG. 7, as the display contents that should be displayed, like the traditional example shown in FIG. 3, the intended display is exemplified as: from a start state at a time point t0 when nothing is displayed, to a time point t2 when "0" is started to be displayed, to a time point t5 when the display is changed from "0" to "2", and to a time point t9 when the display is changed from "2" to "10". That is, in FIG. 7, the intended display is exemplified as: the turning-on pattern which is displayed on the speed display part 11 is the turning-on pattern A at the time point t0, is changed from the turning-on pattern A to the turning-on pattern B at the time point t2, is changed from the turning-on pattern B to the turning-on pattern C at the time point t5, and is changed from the turning-on pattern C to the turning-on pattern D at the time point t9.

First, before the turning-on signal to start the display "0" (the turning-on signal to turn on the turning-on pattern B) is output to the LCD driver 105 at the time point t2, in the period 2T from a time point t1 to the time point t2, the microcomputer 101 outputs a signal as the dummy turning-on signal to apply a dummy voltage to a dummy segment group A which includes all segments a, b, c, d, e, f, g, h, i, j, k, l, m and n. Because there is no previous turning-on pattern since the turning-on pattern is changed for the first time at the time point t2, the turning-on pattern A for which no segment is turned on is regarded as the previous turning-on pattern, and those segments (that is, all the segments), which are not commonly in the segment group A of the turning-on pattern A, of all the segments are selected as the dummy segment group A, The LCD 105 which receives the dummy turning-on signal applies the dummy voltage to the segments included in the dummy segment group A.

At the time point t2, the microcomputer 101 outputs a turning-on signal to start the display of "0" (a turning-on signal to turn on the turning-on pattern B) to the LCD driver 105. At this time, as shown in FIG. 7, 2T after the microcomputer 101 outputs the turning-on signal (from the time point t2), "0" is displayed on the speed display part 11. This is because, as described previously, before the time point when the turning-on pattern is changed (t2), the dummy turning-on signal is input into the LCD driver 105 to apply the dummy voltage to the dummy segment group A, so that the response time of the segment group B of the turning-on pattern B is equal to the response time C (2T) until a segment which is commonly used in the previous turning-on pattern is turned on. That is, for the liquid crystal display device 100 according to the present embodiment, by applying in advance the dummy voltage whose voltage value is smaller than the critical voltage to the segments which are newly turned on and to which the critical voltage should be applied after the turning-on pattern is changed, the response time until the segments are turned on is equalized to the response time which is 2T until a segment which is commonly used in the previous turning-on pattern is turned on. Compare to the traditional display control shown in FIG. 3, for which it takes 4T from the time when the microcomputer 101 outputs the turning-on signal to turn on the turning-on pattern B to the time when "0" is displayed on the speed display part 11, the display control of the present embodiment shortens the time to 2T because the dummy turning-on control is performed.

Before the turning-on signal to start the display of "2" (the turning-on signal to turn on the turning-on pattern C) is output to the LCD driver 105 at the time point t5, in the period 2T from a time point t4 to the time point t5, the microcomputer 101 outputs a signal as the dummy turning-on signal to turn on a dummy segment group B which includes all segments a, b, c, d, e, f, g, h, i, j, k, l, m and n. Like the dummy segment group A, because the previous turning-on pattern is the turning-on pattern A for which no segment is turned on, those of all the segments which are not common to the segment group A of the turning-on pattern A (that is, all the segments) are selected as the dummy segment group B. The LCD 105 which receives the dummy turning-on signal applies the dummy voltage to the segments included in the dummy segment group B.

At the time point t5, the microcomputer 101 outputs a turning-on signal to start the display of "2" (a turning-on signal to turn on the turning-on pattern C) to the LCD driver 105. As shown in FIG. 7, because the dummy turning-on signal is input into the LCD driver 105 before the time when the turning-on pattern is changed (t5), 2T after the microcomputer 101 outputs the turning-on signal (from the time point t5), "2" is displayed on the speed display part 11.

After the turning-on signal to start the display of "2" (the turning-on signal to turn on the turning-on pattern C) is output to the LCD driver 105 at the time point t5, during 1T from the time point t5 to the time point t6, the microcomputer 101 outputs a signal as a delayed turning-off signal to turn on a delayed turning-off segment group A which includes the segments c and f, together with the turning-on signal to turn on the turning-on pattern C described above. That is, as shown in FIG. 7, in the period from the time point t5 to the time point t6, the microcomputer 101 outputs signals, as turning-on signals, which include the delayed turning-off signal and the signal to turn on the turning-on pattern C as described above to the LCD driver 105 to turn on the segment group which includes the segments a, b, c, d, e, f and g. A segment group, which is not commonly used in the turning-on pattern C which is the turning-on pattern after the change, of the turning-on pattern B which is the turning-on pattern before the change is selected as the delayed turning-off segment group A. The time length in which the microcomputer 101 outputs the delayed turning-off signal to the LCD driver 105 is set to be 1T, because 1T is obtained by subtracting 1T which is the response time until the segments are turned off from 2T which is the response time until the segments are turned on.

As shown in FIG. 6, the difference between the response time until a segment is turned on and the response time until a segment is turned off is changed in response to the value of an ambient temperature T. More specifically, the difference becomes larger as the value of the ambient temperature T becomes smaller. For the liquid crystal display device 100 according to the present embodiment, the time length in which the above delayed turning-off signal is output is set under the assumption that the ambient temperature T is 5° C. That is, under a temperature environment where the ambient temperature T is 5° C., 1T is set by subtracting the response time until the segments are turned off from the response time until the segments are turned on.

Thus, while for the traditional display control as shown in FIG. 3 during 3T from the time point t4 to the time point t5, only the segments a, b, d and e in the segment group C are displayed, for the display control according to the present embodiment, because the dummy turning-on control and the delayed turning-off control are performed, as shown in FIG. 7, 2T after the microcomputer 101 outputs the turning-on signal to turn on the turning-on pattern C (from the time point t5), the turning-on pattern is changed from the turning-on pattern B to the turning-on pattern C at once, and "2" is displayed on the speed display part 11.

Like the display control described above, before the turning-on signal to start the display of "10" (the turning-on signal to turn on the turning-on pattern D) is output to the LCD driver 105 at the time point t9, in the period 2T from the time point t8 to the time point t9, the microcomputer 101 outputs a signal as the dummy turning-on signal to turn on a dummy segment group C which includes the segment g and h, i, j, k, l, m and n. Because the previous turning-on pattern is the turning-on pattern B, a group of segments, which are not commonly in the segment group B of the turning-on pattern B, in all the segments, is selected as the dummy segment group C. The LCD 105 which receives the dummy turning-on signal applies the dummy voltage to the segments included in the dummy segment group C.

At the time point t9, the microcomputer 101 outputs a turning-on signal to start the display of "10" (a turning-on signal to turn on the turning-on pattern D) to the LCD driver 105. At this time, as shown in FIG. 7, because the dummy turning-on signal is input into the LCD driver 105 before the time when the turning-on pattern is changed (t9), 2T after the microcomputer 101 outputs the turning-on signal (from the time point t9), "10" is displayed on the speed display part 11.

After the turning-on signal to start the display of "10" (the turning-on signal to turn on the turning-on pattern D) is output to the LCD driver 105 at the time point t9, during 1T from the time point t9 to the time point t10, the microcomputer 101 outputs a signal as a delayed turning-off signal to turn on a delayed turning-off segment group B which includes the segment g, together with the turning-on signal to turn on the turning-on pattern D described above. That is, as shown in FIG. 7, in the period from the time point t9 to the time point t10, the microcomputer 101 outputs signals, as turning-on signals, which include the delayed turning-off signal and the signal to turn on the turning-on pattern C as described above to the LCD driver 105 to turn on the segment group which includes the segments a, b, c, d, e, f, g, i and j. A segment group, which is not commonly used in the turning-on pattern D which is the turning-on pattern after the change, of the turning-on pattern C which is the turning-on pattern before the change is selected as the delayed turning-off segment group B.

Thus, while for the traditional display control as shown in FIG. 3 during 1T from the time point t7 to the time point t8, the segments a, b, d and e in the segment group D are displayed, and during 2T from the time point t8 to the time point t9, the segments a, b, c, d, e and f are displayed, for the display control according to the present embodiment, because the dummy turning-on control and the delayed turning-off control are performed, as shown in FIG. 7, 2T after the microcomputer 101 outputs the turning-on signal to turn on the turning-on pattern D (from the time point t9), the turning-on pattern is changed from the turning-on pattern C to the turning-on pattern D at once, and "10" is displayed on the speed display part 11.

Even when the turning-on pattern is changed from the turning-on pattern A to the turning-on pattern B at the time point t2, the delayed turning-off control is performed as described below, but since there is no segment group, in the turning-on pattern A which is the turning-on pattern before the change, which is not commonly used in the turning-on pattern B, as a result, no segment is turned on by the delayed turning-off control.

Next, steps of processes that the microcomputer 101 performs when the display control according to the present embodiment is performed are described with reference to FIG. 8. FIG. 8 is a flowchart to describe the display control of the liquid crystal display device 100 according to the present embodiment. In FIG. 8, an example is described in which the microcomputer 101 performs the processes as shown in FIG. 8 periodically, for example, in a time interval of 1/10 of T as shown in FIG. 7, and the turning-on signal control is changed.

When a timing to change the turning-on signal comes, first, in a step S11, the microcomputer 101 determines whether the value of the ambient temperature received from the temperature sensor 103 is equal to or lower than the predetermined temperature threshold T1 which is determined in advance. For example, for the liquid crystal display device 100 according to the present embodiment, 15° C. which is a relatively low temperature inside the vehicle is determined as the value of the temperature threshold T1. When the value of the ambient temperature T, as a result of the determination, is equal to or lower than the temperature threshold T1, the microcomputer 101 performs the process of a step S13. On the other hand, when the value of the ambient temperature T, as a result of the determination, is over the temperature threshold T1, the microcomputer 101 performs the process of a step S12.

In the step S12, the microcomputer 101 determines that it is not necessary to perform the dummy turning-on control and the delayed turning-on control, and only the turning-on signal (a normal turning-on signal) that should be output to the LCD driver 105 at the moment, as a signal which should be output to the LCD driver 105, is stored in, for example, an output register. Then, the microcomputer 101 performs the process of a step S19.

In the step S13, the microcomputer 101 determines whether it is a timing to output a dummy turning-on signal. More specifically, the microcomputer 101 determines whether the current time belongs to a period of a predetermined time (in the above display control example, the period is 2T) before the time point when the display of the speed display part 11 is changed. When it is determined that it is a timing to output a dummy signal as a result of the determination, the microcomputer 101 performs the process of a step S14. On the other hand, when it is determined that it is not a timing to output a dummy signal as a result of the determination, the microcomputer 101 performs the process of a step S17.

In the step S14, the microcomputer 101 determines whether it is a timing to output a delayed turning-off signal. More specifically, the microcomputer 101 determines whether the current time belongs to a period of a predetermined time (in the above display control example, the period is 1T) after the time point when the display of the speed display part 11 is changed. When it is determined that it is a timing to output a delayed turning-off signal as a result of the determination, the microcomputer 101 performs the process of a step S15. On the other hand, when it is determined that it is not a timing to output a delayed turning-off signal as a result of the determination, the microcomputer 101 performs the process of a step S16.

In the step S15, the microcomputer 101 determines that it is a timing to perform the dummy turning-on control and the delayed turning-on control, and stores the dummy turning-on signal and the delayed turning-off signal, as well as the normal turning-on signal, as signals which should be output to the LCD driver 105 in, for example, the output register. Then, the microcomputer 101 performs the process of a step S19.

In the step S16, the microcomputer 101 determines that it is a timing to perform the dummy turning-on control, and stores the dummy turning-on signal as well as the normal turning-on signal, as signals which should be output to the LCD driver 105 in, for example, the output register. Then, the microcomputer 101 performs the process of the step S19.

In the step S17, the microcomputer 101 determines whether it is a timing to output a delayed turning-off signal. More specifically, the microcomputer 101 determines whether the current time belongs to a period of a predetermined time (in the above display control example, the period is 1T) after the time point when the display of the speed display part 11 is changed. When it is determined that it is a timing to output a delayed turning-off signal as a result of the determination, the microcomputer 101 performs the process of a step S18. On the other hand, when it is determined that it is not a timing to output a delayed turning-off signal as a result of the determination, the microcomputer 101 performs the process of the above step S12.

In the step S18, the microcomputer 101 determines that it is a timing to perform the delayed turning-off control, and stores the delayed turning-off signal as well as the normal turning-on signal, as signals which should be output to the LCD driver 105 in, for example, the output register. Then, the microcomputer 101 performs the process of the step S19.

In the step S19, the microcomputer 101 outputs the signals stored in the output register to the LCD driver 105 and makes the LCD driver 105 apply voltages to the segments of the LCD 104. Thereby, the LCD 104 operates according to the signals output by the LCD driver 105, and the segments of the speed display part 11 are controlled to be turned on or turned off.

Every time a timing to change the turning-on signal comes, the microcomputer 101 performs the above-described processes repeatedly, and controls the segments of the speed display part 11 to be turned on or turned off.

In the following, the operation and effect of the liquid crystal display device 100 according to the present embodiment is described.

The liquid crystal display device 100 according to the present embodiment includes the LCD 104 (a display part) which has a plurality of divided segments, and the microcomputer 101 (a control part), configured to control the voltage values applied to the segments to turn on or turn off the segments.

When the microcomputer 101 changes the turning-on pattern output to the LCD 104 from a first turning-on pattern (the turning-on pattern B) for which a first segment group (for example, the segment group B) selected from the plurality of segments are turned on, to a second turning-on pattern (the turning-on pattern C) for which a second segment group (for example, the segment group C) selected from the plurality of segments are turned on, and subsequently to a third turning-on pattern (the turning-on pattern D) for which a third segment group (for example, the segment group D) selected from the plurality of segments are turned on, in a period from a predetermined time (time 2T) before starting the change (the time point t9) from the second turning-on pattern (the turning-on pattern C) to the third turning-on pattern (the turning-on pattern D), the microcomputer 101 applies a dummy voltage to the segments (a dummy segment group C) of the whole of the segments, which are not commonly used in the first segment group (the segment group B).

Thereby, it is prevented from occurring to lengthen an elapsed time from the previous turning-off time when the segments are turned on, and the response time for turning on the segments is unified into the response time for turning on the segments which are common in the previous turning-on pattern. Thus, the deviation in display due to the fact that the response time until the segments are turned on are different depending on elapsed time from the previous turning-off time can be prevented from occurring.

As a result, according to the liquid crystal display device 100 of the present embodiment, a liquid crystal display device whose visibility is improved can be provided.

The liquid crystal display device 100 according to the present embodiment further includes the temperature sensor 103 (a temperature detecting part), configured to detects the ambient temperature T of the liquid crystal display device 100.

When a value of the ambient temperature T acquired from the temperature sensor 103 is equal to or lower than the predetermined threshold T1 (for example, in the present embodiment, 15° C.), the microcomputer 101 applies a dummy voltage to the segments (the dummy segment group C) of the whole segments which are not commonly used in the first segment group (the segment group B) (FIG. 8, step S11).

In this way, for the liquid crystal display device 100 according to the present embodiment, when it is determined that the value of the ambient temperature T of the liquid crystal display device 100 is equal to or lower than the predetermined threshold T1, a dummy voltage is applied to segments of the whole segments which are not commonly used in the first segment group. Thereby, even if the liquid crystal display device 100 is used in a low temperature environment where the difference of the response times until segments are turned on depending on elapsed time from the previous turning-off time is easy to appear apparently, the deviation in display is effectively prevented from occurring. In other words, the liquid crystal display device 100 is used in a relatively high temperature environment where the difference of the response times until segments are turned on depending on elapsed time from the previous turning-off time is hard to appear apparently, the dummy turning-on control is not performed, thereby decreasing the consumption of power.

For the liquid crystal display device 100 according to the present embodiment, for example, in a period from a predetermined time (time 2T) before a change time point (the time point t9) from the second turning-on pattern (the turning-on pattern C) to the third turning-on pattern (the turning-on pattern D) to the change time point (the time point t9), the microcomputer 101 applies a dummy voltage to the segments (the dummy segment group C) of the whole segments, which are not commonly used in the first segment group (the segment group B), and applies a delayed turning-off voltage to the segments (the delayed turning-off segment group B) of the first segment group (the segment group B) which are not commonly used in the second segment group (the segment group C).

Thereby, the deviation in display due to the fact that the response time until the segments are turned on is longer than the response time until the segments are turned off can be more effectively prevented from occurring in addition for the deviation in display due to the fact that the response times until the segments are turned on are different depending on an elapsed time from the previous turning-off time.

For the liquid crystal display device 100 according to the present embodiment, for example, only in 1T, which is the difference between the response time until the segments are turned on and the response time until the segments are turned off under a predetermined temperature environment (for example, in the present embodiment, 5° C.), from the time point (the time point t9) when the second turning-on pattern (the turning-on pattern C) is changed to the third turning-on pattern (the turning-on pattern D), the microcomputer 101 applies a delayed turning-off voltage to the segments (the delayed turning-off segment group B) of the first segment group (the segment group B), which are not commonly used in the second segment group (the segment group C).

Thereby, the deviation in display due to the fact the response time until the segments are turned on is longer than the response time until the segments are turned off can be more effectively prevented from occurring.

The technical scope of the present invention is not limited to the above described embodiments. The above described embodiments can be accompanied by various kinds of modifications or improvements in the technical scope of the present invention.

For example, for the display control as exemplified in FIG. 7, a control for combining the two display controls of the dummy turning-on control and the delayed turning-off control is descried, but it is not a problem to adopt a configuration with the dummy turning-on control without the delayed turning-off control. In this configuration, the deviation in display which is caused by the difference between the response time until a segment is turned on and the response time until a segment is turned off cannot be prevented, but the deviation in display which is caused by the difference between the response time until a segment is newly turned on and the response time until a segment which is commonly used in the previous turning-on pattern is turned on can be prevented from occurring. Namely, along with the example shown in FIG. 3 and FIG. 7, for the traditional display control, 4T time may be necessary to actually display the turning-on patter after change on the speed display part 11 after a turning-on signal for turning on the turning-on patter after change is output, but the necessary time can be shortened to 2T for the display control according to this configuration.

In addition, for the liquid crystal display device 100 in the present embodiment, the dummy turning-on control is so performed that in a period from 2T before the time point when the turning-on pattern is changed to the time point when the turning-on pattern is changed, a dummy voltage is applied to the group of segments, which are not commonly used in the previous turning-on pattern, in all the segments, but the period in which the dummy voltage is applied may be changed appropriately. For example, the period may be 1T or 3T. The period may be also a variable value which is changed in response to the value of the panel temperature (or the ambient temperature T) of the LCD 104.

For the liquid crystal display device 100 according to the present embodiment, the dummy turning-on control is so performed that in a period from 2T before the time point when the turning-on pattern is changed to the time point when the turning-on pattern is changed, a dummy voltage is applied to the whole group of segments, which are not commonly used in the previous turning-on pattern, in all the segments. It is not necessary, however, to apply the dummy voltage to the whole segment group, and the dummy voltage may be applied to at least one of the segments in the segment group. For example, the dummy voltage may be applied only to the segments for which the responsiveness or the visibility becomes a problem.

Similarly, for the liquid crystal display device 100 according to the present embodiment, the delayed turning-off control is so performed that in a period of 1T after the time point when the turning-on pattern is changed, a delayed turning-off voltage is applied to the whole group of segments, which are not commonly used in the turning-on pattern after the change, of the turning-on pattern before the change. It is not necessary, however, to apply the delayed turning-off voltage to the whole segment group, and the delayed turning-off voltage may be applied to at least one of the segments in the segment group. For example, the delayed turning-off voltage may be applied only to the segments for which the responsiveness or the visibility becomes a problem.

For the liquid crystal display device 100 in the present embodiment, the dummy turning-on control is so performed that in a period from 2T before the time point when the turning-on pattern is changed to the time point when the turning-on pattern is changed, a dummy voltage is applied to the group of segments, which are not commonly used in the previous turning-on pattern, in all the segments, but not only the previous turning-on pattern, but also the turning-on pattern before the previous turning-on pattern may be considered to decide the segments to which the dummy voltage is applied.

The voltage values of the critical voltage, the dummy voltage and the delayed turning-off voltage, the response time lengths of the response time A, the response time B and the response time C, and the temperature value of the threshold T1 and the like shown in the present embodiment are examples, respectively. The technical scope of the present invention is not limited to the embodiments.

For the liquid crystal display device 100 according to the present embodiment, the time in which the dummy voltage is applied in the dummy turning-on control and the time in which the delayed turning-off voltage is applied in the delayed turning-off control have certain values, respectively. However, these times may be changed at any time in response to the value of the ambient temperature T received from the temperature sensor 103. For example, in this case, for the delayed turning-off control, it is also possible that, after the microcomputer 101 performs the process in the step S11 in FIG. 8, the microcomputer 101, based on the value of the current ambient temperature T and the relationship between the response time until a segment is turned on and the response time until a segment is turned off shown in FIG. 6, calculates a time by subtracting the response time until a segment is turned off from the response time until a segment is turned on, and assumes the calculated time as the time in which the delayed turning-off voltage is applied. For the dummy turning-on control, it is also possible that, after the microcomputer 101 performs the process in the step S11 in FIG. 8, the microcomputer 101, based on the data which are given in response to the ambient temperature T, the elapsed time from the previous turning-off time point, and the response time until a segment is turned on, calculates a time in which the dummy voltage should be applied under the current ambient temperature, and assumes the calculated time as the time in which the dummy voltage is applied.

For the liquid crystal display device 100 according to the present embodiment, when the dummy turning-on control is performed, in a period from 2T before the time point when the turning-on pattern is changed to the time point when the turning-on pattern is changed, a dummy voltage is applied to the segment group, which is not commonly used in the previous turning-on pattern, of all the segments, but in addition, the dummy voltage may be applied in a predetermined time after the time point of the change.

For the liquid crystal display device 100 according to the present embodiment, the microcomputer 101 controls the display of the LCD 104 in a dynamic drive mode in which the microcomputer 101 applies a voltage whose voltage value is variable to the segments of the LCD 104, but the microcomputer 101 may control the display of the LCD 104 in a static drive mode in which the microcomputer 101 applies a voltage whose voltage value is constant.

That is, for the liquid crystal display device 100 according to the present embodiment, when the dummy turning-on control is performed, a dummy voltage whose absolute voltage value is smaller than the critical voltage is applied to the dummy segment group, but when the static drive mode is adopted, a dummy voltage whose absolute voltage value is larger than the critical voltage (for example, 5V) may be applied to the dummy segment group. When a voltage whose absolute voltage value is larger than the critical voltage is applied to the dummy segment group as the dummy voltage, the time length in which the dummy voltage is applied may be set to be smaller than the response time until the segments are newly turned on.

What is claimed is:

1. A liquid crystal display device, comprising:

a display part which has a plurality of divided segments; and a control part, configured to control voltages applied to the segments to turn on or turn off each of the segments, wherein the control part changes a turning-on pattern of segments to be output to the display part from a first turning-on pattern to a second turning-on pattern, and subsequently to a third turning-on pattern, wherein the first turning-on pattern turns on a first segment group selected from the plurality of segments, the second turning-on pattern turns on a second segment group selected from the plurality of segments, and the third turning-on pattern turns on a third segment group selected from the plurality of segments, wherein change of the turning-on pattern includes a control to apply a voltage to at least one of segments of the plurality of segments which are not commonly used in the first segment group in a period from a predetermined time before starting of change from the second turning-on pattern to the third turning-on pattern to the starting of the change.

2. The liquid crystal display device according to claim 1, further comprising a temperature detecting part, configured to detect an ambient temperature of the liquid crystal display device, wherein the control part applies a voltage to at least one of segments of the plurality of segments which are not commonly used in the first segment group in a case where it is determined that a value of the ambient temperature acquired by the temperature detecting part is equal to or lower than a given threshold.

3. The liquid crystal display device according to claim 2, wherein the given threshold is approximately 15° C.

4. The liquid crystal display device according to claim 1, wherein the control part applies a voltage to at least one of segments of the plurality of segments which are not commonly used in the first segment group in the period from the predetermined time before the starting of the change to the starting of the change, and to apply a voltage to at least one of the first segment group which are not commonly in the second segment group for a predetermined time from the starting of the change.

5. The liquid crystal display device according to claim 4, wherein the control part applies a voltage to at least one of the segments of the first segment group which are not commonly used in the second segment group from starting of the change, in a time period obtained by subtracting a response time until the segments are turned off from a response time until the segments are turned on under a predetermined temperature environment.

6. The liquid crystal display device according to claim 1, wherein the control part applies a dummy voltage to the at least one of the segments, the dummy voltage being less than a voltage required to turn on the at least one of the segments in the period.

* * * * *